United States Patent [19]

Pena et al.

[11] Patent Number: 4,746,775

[45] Date of Patent: May 24, 1988

[54] FLUID FLOW SWITCH ASSEMBLY

[76] Inventors: Jose C. Pena; Rolando J. Pena, both of 3809 Park Ave., Union City, N.J. 07087

[21] Appl. No.: 810,666

[22] Filed: Dec. 17, 1985

[51] Int. Cl.[4] ..... H01H 35/40

[52] U.S. Cl. ..... 200/81.9 R; 73/861.76

[58] Field of Search ..... 374/138, 147, 39; 165/11.1; 200/81.9 R; 73/861.75, 861.76

[56] References Cited

U.S. PATENT DOCUMENTS

| | | | |
|---|---|---|---|
| 2,119,783 | 6/1938 | Harrington | 200/81.9 R |
| 2,276,100 | 3/1942 | Scholin | 200/81.9 R |
| 2,966,133 | 12/1960 | Hube | 73/861.75 X |
| 3,005,888 | 10/1961 | Putz | 200/81.9 R |
| 3,995,686 | 12/1976 | Laube | 165/11.1 |
| 4,013,218 | 3/1977 | King | 236/94 X |
| 4,074,097 | 2/1978 | Hutchinson et al. | 73/861.76 X |
| 4,454,768 | 6/1984 | Nansel | 200/81.9 R X |

FOREIGN PATENT DOCUMENTS

| | | | |
|---|---|---|---|
| 3241702 | 5/1984 | Fed. Rep. of Germany | 73/861.76 |
| 0034116 | 2/1984 | Japan | 73/861.76 |

*Primary Examiner*—Daniel M. Yasich

*Attorney, Agent, or Firm*—Louis E. Marn

[57] ABSTRACT

There is disclosed a fluid flow switch assembly comprised of a conduit member having an area of predetermined cross-section and a port portion and further including a plate member mounted for rotation in the conduit member and disposed over the area of predetermined cross-section whereby rotation of the plate member during fluid flow closes an electrical circuit in a switch assembly disposed in the port portion of the conduit member.

7 Claims, 1 Drawing Sheet

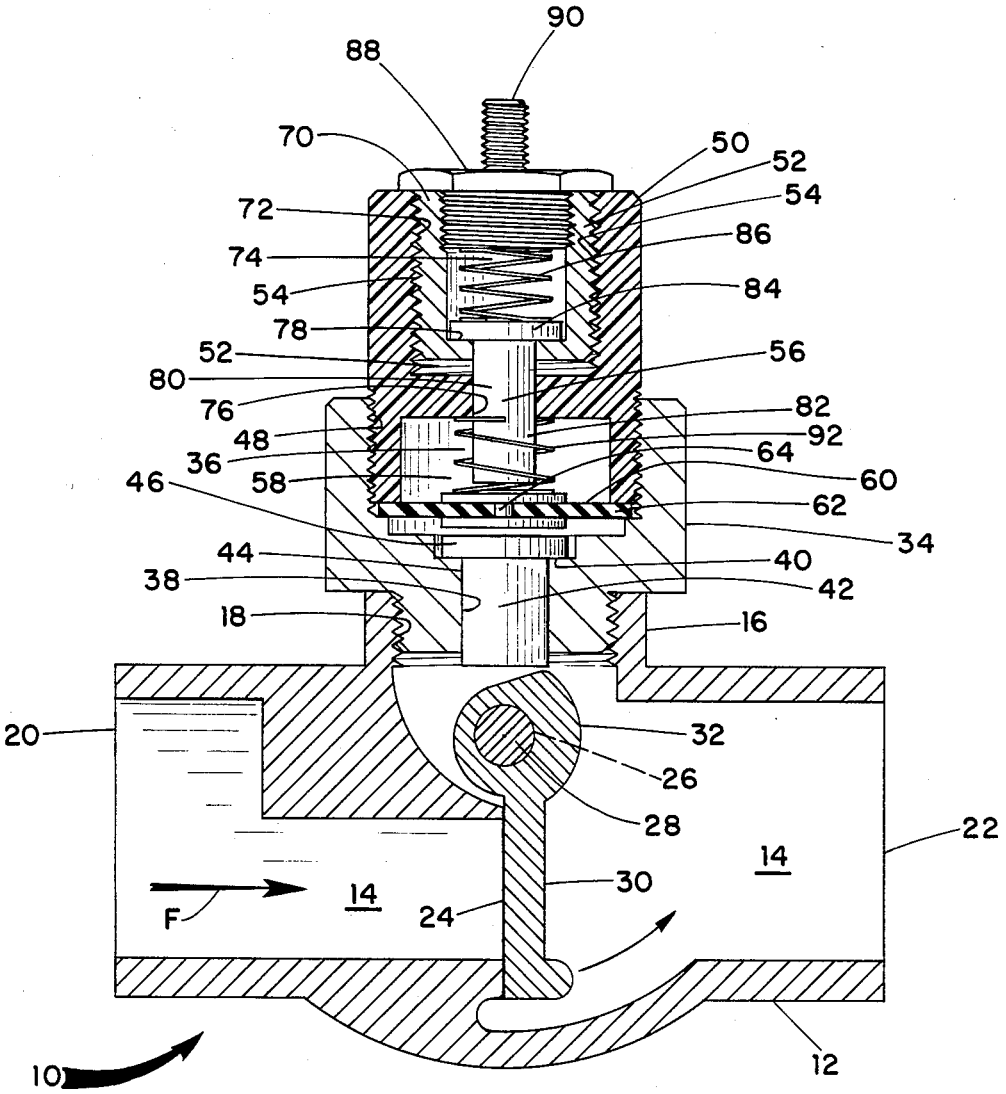
90
88
70
50
52
54
72
86
74
84
54
78
52
56
80
76
82
48
92
36
64
46
58
60
62
34
44
40
38
42
18
16
20
32
26
28
22
14
30
14
F
24
10
12

FLUID FLOW SWITCH ASSEMBLY

BACKGROUND OF THE INVENTION

1. Field of the Invention

This invention relates to a switch assembly, and more particularly to a fluid flow switch assembly for indicating a flow of fluid therethrough.

2. Description of the Prior Art

In many multiple-occupancy buildings, such as apartment or office buildings, the amount of energy consumed for comfort heating is measured only by a central meter, indicating total energy consumption for the entire building. The cost of the energy used is reflected in the rental or maintenance charges paid by the occupants, but is not pro-rated on the basis of the actual amounts of energy used by the respective tenants, since there is no measurement of the respective amounts. In fact, some cities have ordinances requiring that the cost of electricity be included in the rental rate, in the case of all electrically heated apartments. Studies have shown that buildings wherein energy consumption is centrally metered regularly consume more energy per unit of space served than do building wherein energy use is individually metered, other conditions being equal. In most cases, the largest source of energy consumption in multiple-occupancy buildings is comfort control.

In U.S. Pat. No. 4,558,958, there is disclosed an energy consumption indicating system for a multiple-occupancy dwelling including a plurality of units each having a space heat exchanger and a thermostat and wherein said multiple-occupancy dwelling is provided with a main heat exchanger having an outlet conduit, an inlet conduit and at least one circulating pump and wherein a conduit member is provided for each unit in fluid communication with the main heat exchanger and the space heat exchanger in each unit and wherein fluid flow through each conduit member is effected in response to a thermostat in each unit and wherein a time meter for each unit is energized to measure time duration of fluid flow through the conduit member.

OBJECTS OF THE PRESENT INVENTION

An object of the present invention is to provide an improved fluid flow switch assembly.

Another object of the present invention is to provide an improved fluid flow switch assembly for a heating system for a multiple-occupancy building.

Yet another object of the present invention is to provide an improved fluid flow switch assembly indicative of individually controlled levels of heat in the respective dwellings of a multiple-occupancy building.

SUMMARY OF THE INVENTION

These and other objects of the present invention are achieved by a fluid flow switch assembly comprised of a conduit member having an area of predetermined cross-section and a port portion and further including a plate member mounted for rotation in the conduit member and disposed over the area of predetermined cross-section whereby rotation of the plate member during fluid flow closes an electrical circuit in a switch assembly disposed in the port portion of the conduit member.

BRIEF DESCRIPTION OF THE DRAWING

The present invention will be more clearly understood by reference to the following detailed description of an exemplary embodiment thereof wherein the drawing is a cross-sectional view of the fluid flow switch assembly of the present invention.

DETAILED DESCRIPTION OF THE INVENTION

Referring now to the drawing, there is illustrated a fluid flow switch assembly generally indicated as 10, comprised of a cylindrically-shaped conduit member 12 defining a channel 14 and formed with a port member 16 including internal threads 18 perpendicularly-disposed to the cylindrically-shaped conduit member 12. The conduit member 12 includes an inlet end 20 and an outlet end 22. Intermediate the inlet end 20 and the outlet end 22 of the conduit member 12, the conduit member 12 is formed with a channel section 24 of reduced cross-sectional area compared with the channel 14 and perpendicularly disposed to the axis of the port member 16.

In the plane of the axis of the port member 16 and above the axis of the conduit member 12, there are formed on either side of the conduit member orifices 26 in which is disposed for rotation a shaft member 28 mounted to a generally planar-shaped flap member 30 extending downwardly in the conduit member 12 and extending over the channel section 24. The flap member 30 includes a cammed surface 32 in coaxial alignment with the axis of the shaft member 28 as more fully hereinafter discussed.

A cylindrically-shaped sleeve member 34 of a conductive material including an upper chamber 36 and a lower chamber 38 defining a shoulder portion 40 coaxially formed therein is coupled, such as by threading, into the threaded portion 18 of the port member 16. The sleeve member 34 is connected by a conductor (not shown) to ground. In the lower chamber 38, there is disposed a pin member 42 formed of a conductive material including a shank 44 and an enlarged head portion 46 seated on the shoulder portion 40 of the sleeve member 34. The upper chamber 36 is defined by a threaded interior surface 48 in which is disposed a cylindrically-shaped housing member 50 of a non-conductive material, such as plastic.

The housing member 50 is formed with an upper chamber 52 having a threaded interior surface 54, an intermediate chamber 56 and a lower chamber 58 wherein the intermediate chamber 56 is of a reduced cross-section compared with the upper and lower chambers 52 and 58, respectively.

Within the upper chamber 36 of the sleeve member 34, there is positioned a diaphragm member 60 comprised of a disc-shaped dielectric section 62 to which is mounted a spool-shaped member 64 of a conductive material. The diaphragm member 60 is held in position within the upper chamber 36 by the housing member 50 threaded within the threaded inner surface portion 48 of the upper chamber 36 of the sleeve member 34.

Within the upper chamber 52 of the housing member 50 there is positioned a cylindrically-shaped member 70 of a conductive material formed with an external thread 72 and an upper chamber 74 and a lower chamber 76 defining a shoulder portion 78. Within the upper chamber 74 there is positioned a pin member 80 of a conductive material. The pin member 80 is formed with a shank portion 82 extending through the lower chamber 76 into the lower chamber 58 of the housing member 50 and with a head portion 84 disposed on the shoulder portion 78 of the sleeve member 70.

Within the upper chamber 74 of the sleeve member 70 there is disposed a spring 86 held in compression therein by a locking screw member 88 formed of a conductive material and threaded within the upper chamber 74 of the sleeve member 70. The locking screw member 88 is provided with a post member 90 for connecting same by a conductor (not shown) to a source of DC current via the energy consumption indicating system as described in the aforementioned copending application. A spring 92, in compression, is positioned about the shank portion 82 of the pin member 80 disposed within the lower chamber 58 of the housing member 50 to maintain a gap between a lower surface of the shank portion 82 of the pin member 80 and the spool-shaped member 64 of the diaphragm member 60.

In operation, a non-fluid flow state, the components of the fluid flow switch assembly 10 are in the position illustrated in the drawing with an opened electrical circuit between the post member 90 and ground via the sleeve member 34 as a result of the gap between the head portion 46 of the pin member 42 and the spool-shaped member 64 of the diaphragm member 60 and the gap between the spool-shaped member 64 of the diaphragm member 60 and the shank portion 82 of the pin member 84. Upon initiation of a flow of fluid (gas or liquid) in the direction of the arrow (F), the flap member 30 is caused to move in a counter-clockwise direction about the shaft member 28 whereby the cammed surface 32 in contact with the shank portion 44 of the pin member 42 causes the pin member 42 to move vertically upward and cause the head portion 46 to contact the spool-shaped portion 64 of the diaphragm member 60. Continued upward movement of the pin member 42 against the compression force of the spring 92 causes the spool-shaped member 64 to contact the shank portion 82 of the pin member 80 thereby closing an electrical circuit between the post member 90 and ground thereby to actuate a meter (not shown) indicative of fluid flow as discussed in each aforementioned copending application. Generally, an opened or closed electrical circuit is a result of the gap between the spool-shaped member 64 of the diaphragm member 60 and the lower portion of the shank portion 82 of the pin member 80, it being understood that the spring 92 is configured and positioned in a manner not in direct contact with the shank portion 82 of the pin member 80.

While the present invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. An improved fluid flow switch assembly which comprises:

a conduit member having an area of predetermined cross-section and a port portion;

a plate member disposed over said predetermined cross-sectional area and mounted for rotation in said conduit member, said plate member including a cammed surface portion;

an insulating sleeve member cooperating with said port portion of said conduit member;

a first conductive member disposed in said insulating sleeve member; and a second conductive member positioned in said port portion of said conduit member whereby rotation of said plate member in response to fluid flow through said conduit member causes said cammed surface portion thereof to move said second conductive member into contact with said first conductive member and thereby for closing an electrical circuit between said conductive members.

2. The improved fluid flow switch as defined in claim 1 wherein said first conductive member is spring-loaded.

3. The improved fluid flow switch as defined in claim 1 wherein said second conductive member is spring-loaded to an opened electrical circuit configuration.

4. The improved fluid flow switch as defined in claim 1 wherein said plate member is mounted for rotation at a point above a plane defining said area of predetermined cross-section.

5. The improved fluid flow switch as defined in claim 4 wherein an axis of rotation of said plate member is in coaxial alignment with said insulating sleeve member.

6. The improved fluid flow switch as defined in claim 1 and further including a housing member disposed in said port portion of said conduit member for receiving said insulating sleeve member.

7. The improved fluid flow switch as defined in claim 6 and further including a dielectric member disposed between said housing member and said insulating sleeve member and having a conductive element disposed therein for providing electrical contact between said first and second conductive members.

* * * * *